US011591897B2

(12) United States Patent
Moberg et al.

(10) Patent No.: US 11,591,897 B2
(45) Date of Patent: Feb. 28, 2023

(54) ANTI-JAM CONTROL SYSTEM FOR MOBILE DRILLING MACHINES

(71) Applicants: Caterpillar Global Mining Equipment LLC, Denison, TX (US); Caterpillar Global Mining HMS GmbH, Dortmund (DE)

(72) Inventors: Carl J. Moberg, Dunlap, IL (US); Timo Diekmann, Castrop-Rauxel (DE); Ross L. Hoult, Queensland (AU); Cary Gist, Ravenna, TX (US); Rajesh R. Gunda, Dunlap, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 16/923,256

(22) Filed: Jul. 8, 2020

(65) Prior Publication Data

US 2021/0017849 A1 Jan. 21, 2021

Related U.S. Application Data

(60) Provisional application No. 62/876,642, filed on Jul. 20, 2019.

(51) Int. Cl.

| | |
|---|---|
| ***E21B 44/04*** | (2006.01) |
| ***E21B 47/06*** | (2012.01) |
| ***E21B 7/02*** | (2006.01) |

(52) U.S. Cl.
CPC ..... *E21B 44/04* (2013.01); *E21B 7/022* (2013.01); *E21B 47/06* (2013.01)

(58) Field of Classification Search
CPC ..... E21B 44/04
See application file for complete search history.

(56) References Cited

U.S. PATENT DOCUMENTS

| | | | |
|---|---|---|---|
| 8,464,808 | B2 | 6/2013 | Leü |
| 8,905,157 | B2 | 12/2014 | Jiao et al. |
| 9,074,455 | B2 | 7/2015 | Pilgrim et al. |
| 2015/0369030 | A1 | 12/2015 | Hay et al. |
| 2016/0047219 | A1 | 2/2016 | Jeffryes |
| 2018/0156022 | A1 | 6/2018 | Miller |
| 2018/0266235 | A1 | 9/2018 | Stacy, II et al. |

FOREIGN PATENT DOCUMENTS

| | | | |
|---|---|---|---|
| WO | 2019/035848 | A1 | 2/2019 |

*Primary Examiner* — Kristyn A Hall
(74) *Attorney, Agent, or Firm* — Xsensus LLC

(57) ABSTRACT

An anti-jam control system for mobile drilling machines is disclosed. The anti-jam control system may include a method for automatically clearing a jam during an automatic drilling mode of a mobile drilling machine including a drill bit mounted on a drill string. The method may include: monitoring a feed rate of the drill bit during the automatic drilling mode; and automatically initiating an anti-jam operation when the feed rate is below a predetermined feed rate threshold.

16 Claims, 4 Drawing Sheets

ANTI-JAM CONTROL SYSTEM FOR MOBILE DRILLING MACHINES

CROSS-REFERENCE TO RELATED APPLICATIONS

This application claims the benefit of priority under 35 U.S.C. § 119 to U.S. Provisional Patent Application No. 62/876,642, filed on Jul. 20, 2019, the entirety of which is incorporated herein by reference.

TECHNICAL FIELD

The present disclosure relates generally to mobile drilling machines, and more particularly, to an anti-jam control system for such machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more.

Blasthole drilling machines may also include an automatic drilling mode. During the automatic drilling mode, the drill bit may become stuck or jammed. However, it may be difficult to automatically detect and clear a jam before operator intervention is required. As such, a jam may require the operator to end the automatic drilling mode and manually clear the jam.

U.S. Pat. No. 8,464,808, issued to Leü et al. on Jun. 18, 2013 ("the '808 patent"), describes a method and device for controlling a drill rig wherein rig parameters are set by a control unit. The system of the '808 patent includes an anti-jam function that monitors rotation pressure and reverses the feed when the rotation pressure rises to a "jamming limit" level. The '808 patent further discloses terminating all drilling functions if the jamming does not cease within a set time. However, the system of the '808 patent may not adequately provide mitigation procedures to reduce overall drilling time when using an anti-jam function.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a method for automatically clearing a jam during an automatic drilling mode of a mobile drilling machine including a drill bit mounted on a drill string is disclosed. The method may include: monitoring a feed rate of the drill bit during the automatic drilling mode; and automatically initiating an anti-jam operation when the feed rate is below a predetermined feed rate threshold.

In another aspect, a mobile drilling machine is disclosed. The mobile drilling machine may include: a mast including a mast frame; a rotary head movably mounted on the mast frame, the rotary head controllable to rotate a drill bit mounted on a drill string at a rotation speed, wherein the rotary head is further controllable to move up and down the mast frame to feed the drill bit at a feed rate; and a controller configured to: monitor the feed rate of the drill bit during an automatic drilling mode; and automatically initiate an anti-jam operation when the feed rate is below a predetermined feed rate threshold.

In yet another aspect, a method for supervisory control of an anti-jam function during an automatic drilling operation of a mobile drilling machine including a drill bit mounted on a drill string for drilling a hole is disclosed. The method may include: monitoring the anti-jam function during the automatic drilling mode; incrementing a counter each time an anti-jam operation of the anti-jam function is initiated; incrementing the counter at a predetermined rate for an amount of time in the anti-jam operation; and automatically initiating a mitigation procedure when a count of the counter exceeds a threshold.

In yet another aspect, a mobile drilling machine is disclosed. The mobile drilling machine may include: a mast including a mast frame; a rotary head movably mounted on the mast frame, the rotary head controllable to rotate a drill bit mounted on a drill string at a rotation speed, wherein the rotary head is further controllable to move up and down the mast frame to feed the drill bit at a feed rate; and a controller configured to: monitor an anti-jam function during an automatic drilling mode of the mobile drilling machine; increment a counter each time an anti-jam operation of the anti-jam function is initiated; increment the counter at a predetermined rate for an amount of time in the anti-jam operation; and automatically initiate a mitigation procedure when a count of the counter exceeds a threshold.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
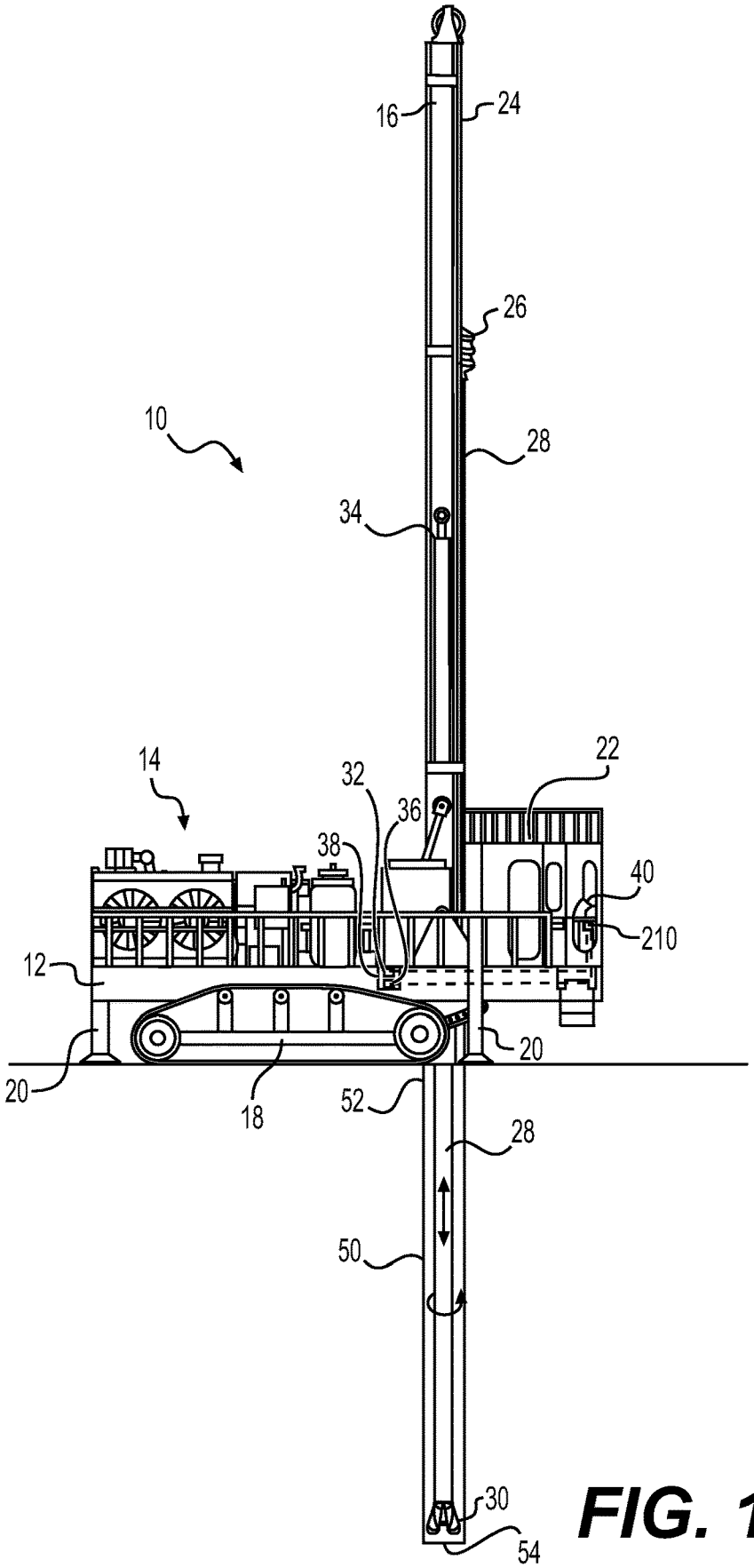
FIG. 1 illustrates a schematic side view of a drilling machine with an exemplary anti-jam control system, according to aspects of the disclosure.

FIG. 1 illustrates a schematic side view of an exemplary drilling machine 10. The disclosure herein may be applicable to any type of drilling machine, however, reference will be made below particularly to a mobile blasthole drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 38 (shown schematically in FIG. 1) and/or any other equipment necessary to power and operate mobile drilling machine 10. Frame 12 may further support an operator cab 22, from which a user, or operator, may maneuver and control mobile drilling machine 10 via an input device 40, such as user interfaces and displays. It is understood that input device 40 may be located remote from mobile drilling machine 10 such that mobile drilling machine 10 may be controlled remotely.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a drill bit 30 may be mounted for drilling into the ground surface for collaring, as further described below. Drill bit 30 may include any type of drill bit, such as, for example, a rotary drill bit, a claw drill bit, a down-the-hole bit, etc. Rotary head 26 may be any type of rotary head, such as a hydraulic rotary head or the like. Rotary head 26 may further include a hydraulic fluid line (not shown) for receiving hydraulic fluid. The hydraulic fluid may be used to rotate a shaft of rotary head 26 on which the drill string 28 is connected for rotating the drill string 28 (and thus rotating drill bit 30). The hydraulic fluid line of rotary head 26 may be coupled to a hydraulic valve 32 (shown schematically in FIG. 1) for controlling the amount, and flow rate, of the hydraulic fluid into rotary head 26. In the exemplary embodiment, hydraulic valve 32 may be located on the hydraulic fluid storage tank 38. However, hydraulic valve 32 may be located anywhere along the hydraulic fluid line of the rotary head 26, as necessary.

Drilling mast 16 may further include a hydraulic feed cylinder 34 (located within mast frame 24) connected to rotary head 26 via a cable and pulley system (not shown) for moving rotary head 26 up and down along the mast frame 24. As such, when hydraulic feed cylinder 34 is extended, hydraulic feed cylinder 34 may exert a force on rotary head 26 for pulling-down rotary head 26 along mast frame 24. Likewise, when hydraulic feed cylinder 34 is retracted, hydraulic feed cylinder 34 may exert a force on rotary head 26 for hoisting up rotary head 26 along mast frame 24. Thus, hydraulic feed cylinder 34 may be controllable to move rotary head 26 up and down the mast frame 24 such that drill bit 30 on drill string 28 may be pulled-down towards, and into, the ground surface or hoisted up from the ground surface. As used herein, the term "feed" in the context of the feed cylinder 34 includes movement of the drill string 28 in either direction (up or down). Hydraulic feed cylinder 34 may include hydraulic fluid lines (not shown) for receiving and conveying hydraulic fluid to and from the feed cylinder 34. The hydraulic fluid may be used to actuate hydraulic cylinder 34 such that a rod of hydraulic cylinder 34 may be extended or retracted. The hydraulic fluid line of hydraulic cylinder 34 may be coupled to hydraulic valves 36 (shown schematically in FIG. 1) for controlling the amount, and flow rate and pressure, of the hydraulic fluid into hydraulic cylinder 34. In the exemplary embodiment, hydraulic valve 36 may be located on the hydraulic fluid storage tank 38. However, hydraulic valve 36 may be located anywhere along the hydraulic fluid line of the hydraulic cylinder 34, as necessary. It is understood that hydraulic fluid may be any type of hydraulic fluid, such as hydraulic oil or the like.

FIG. 1 shows the drill string 28 located in hole 50. The hole 50 includes a collaring portion 52 at a top portion of the hole, and a bottom of the hole 54 (e.g., desired depth of hole). As shown by the arrows in FIG. 1, drill string 28 can rotate, and move up and down (e.g. feed and retract/hoist) such that drill bit 30 rotates and moves up and down, respectively. Further drill string 28 may include water and air lines (not shown) for supplying water and/or compressed air through the drill bit 30 to the hole 50. Drilling machine 10 may include an automatic drilling operation that includes an automatic collar phase, an automatic drill hole phase, and/or an automatic retract phase. The collar phase may include forming a collar portion 52 of the hole 50. The drill hole phase or drilling operation may include drilling the hole 50 after the collar portion 52. The retract phase may include retracting drill bit 30 from the hole 50 when a desired depth is achieved and drilling is complete. During the phases of the automatic drilling operation, the drill bit 30 may potentially jam. Therefore, drilling machine 10 may include an anti-jam control system 200, as detailed further below.

Figure 2:
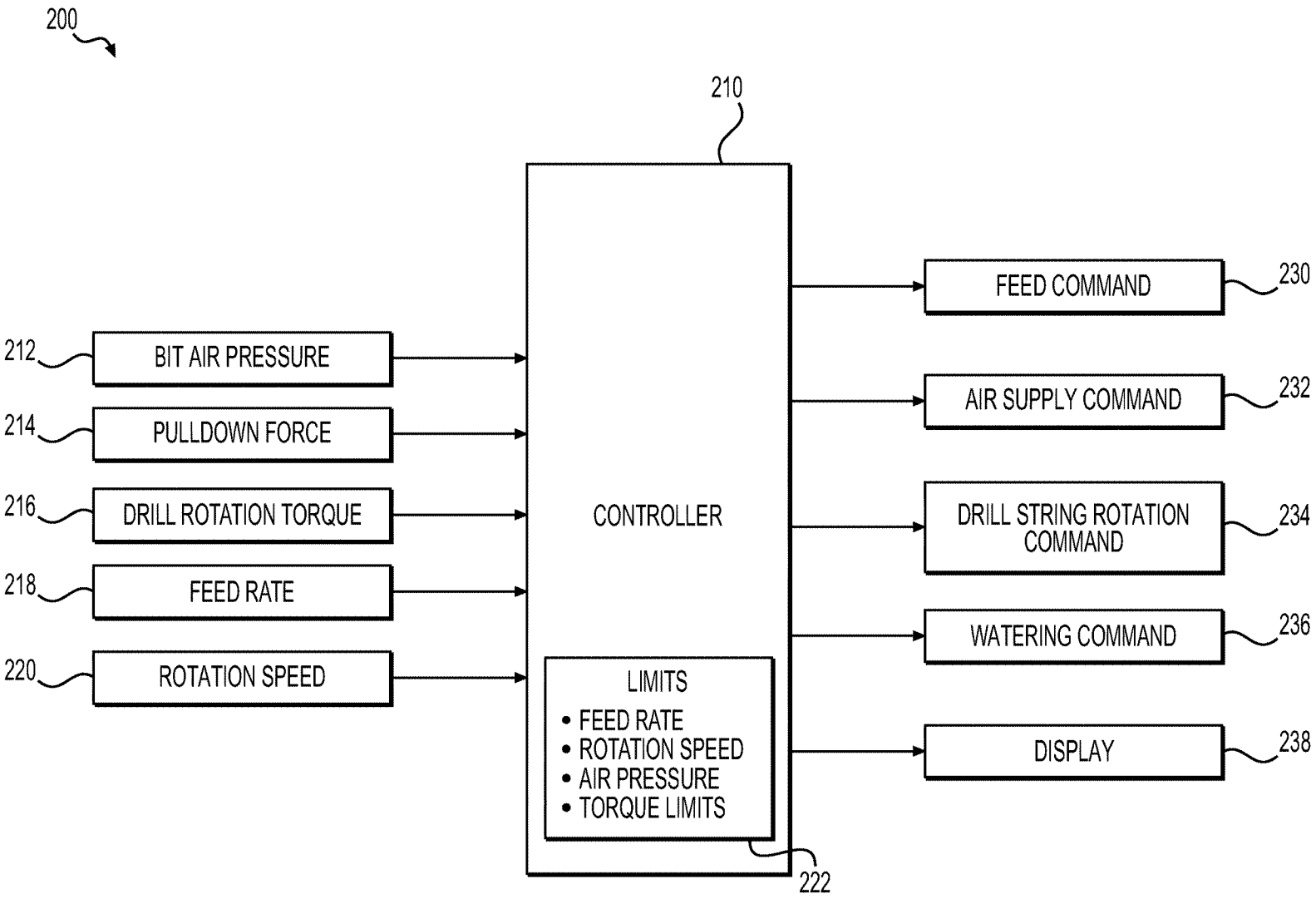
FIG. 2 illustrates a schematic view of the exemplary anti-jam control system of the drilling machine of FIG. 1.

FIG. 2 illustrates a schematic view of the exemplary anti-jam control system 200 of the drilling machine of FIG. 1. Control system 200 may include inputs 212-222, controller 210, and outputs 230-238. The inputs may include sensor input, operator inputs, or stored inputs, for example, feed rate limits, rotation speed limits, air pressure limits and torque limits, bit air pressure 212, pulldown force 214, drill rotation torque 216, feed rate 218, and rotation speed 220. Such sensors, operation input, or stored inputs may be obtained using any conventional system (sensors, user inputs, etc.) The outputs may include, for example, a feed command 230, air supply command 232, drill string rotation command 234, watering command 236, and display information 238 for the operator.

Controller 210 may embody a single microprocessor or multiple microprocessors that may include means for monitoring operation of the drilling machine 10 and issuing instructions to components of machine 10. For example, controller 210 may include a memory, a secondary storage device, a processor, such as a central processing unit, or any other means for accomplishing a task consistent with the present disclosure. The memory or secondary storage device associated with controller 210 may store data and/or software routines that may assist controller 210 in performing its functions. Further, the memory or secondary storage device associated with controller 210 may also store data received from the various inputs 212-222 associated with mobile drilling machine 10. Numerous commercially available microprocessors can be configured to perform the functions of controller 210. It should be appreciated that controller 210 could readily embody a general machine controller capable of controlling numerous other machine functions. Various other known circuits may be associated with controller 210, including signal-conditioning circuitry, communication circuitry, hydraulic or other actuation circuitry, and other appropriate circuitry.

As shown in FIG. 2, controller 210 may include one or more limits 222 of mobile drilling machine 10. The limits may include feed rate limits, rotation speed limits, air pressure limits, and drill rotation torque limits. Feed rate limits may include maximum limits for the feed rate of the drill bit 30. Rotation speed limits may include maximum limits for the rotation speed of the drill bit 30. Air pressure limits may include maximum limits for an amount of air pressure provided for the drill bit 30. Torque limits may include maximum limits for rotational torque on the drill bit 30. These limits 238 may be provided to controller 210 in any conventional manner and may be configurable.

Bit air pressure input 212 may be a sensor for detecting and/or communicating a net force acting on an air supply line. Forces acting on the air supply line may include air pressure. Bit air pressure input 212 may be an air pressure sensor configured to communicate an air pressure signal indicative of air pressure of the air supply line on the drill bit 30 to controller 210. For example, an air pressure sensor may be located in the air supply line adjacent the drill bit 30 so as to detect pressure of fluid (e.g., air) within the air supply line. Bit air pressure input 212 may also derive air pressure information from other sources, including other sensors.

Pulldown force input 214 may be a sensor or other mechanism configured to detect and/or communicate a pulldown force acting on the drill bit 30. The pulldown force acting on the drill bit 30 may be the force exerted by the hydraulic feed cylinder 34 through the rotary head 26 to the drill bit 30. As such, the pulldown force may be derived from a pressure of the hydraulic feed cylinder. Thus, pulldown force input 214 may be a sensor for detecting a net force acting on the hydraulic feed cylinder 34, which may be controlled by controller 210. Forces acting on the hydraulic feed cylinder 34 may include a head end pressure and a rod end pressure. For example, pulldown force input 214 may be one or more pressure sensors configured to communicate a pressure signal to controller 210. The pressure sensors may be disposed within a hydraulic fluid line, at a pump of the hydraulic fluid tank 36, and/or within a head of hydraulic feed cylinder 34. Further, pulldown force input 214 may include a weight of the drill string 28 on the drill bit 30. As such, the pressure signals may be added to the weight of the drill string 28 acting on the drill bit 30 to derive pulldown force input 214. Alternatively, any sensor associated with pulldown force input 214 may be disposed in other locations relative to the hydraulic feed cylinder 34. Pulldown force input 214 may also derive pulldown force information from other sources, including other sensors.

Drill rotation torque input 216 may be one or more sensors or other mechanism configured to detect and/or communicate a rotation torque of the drill bit 30. One or more torque sensors may be physically associated with the drill bit 30 or may be a virtual sensor used to calculate a rotation torque based on sensed parameters such as rotation speed of the rotary head 26 and pressure at the rotary head 26. As such, drill rotation torque input 216 may include one or more sensors (e.g., a speed sensor) for detecting rotation speed of the rotary head 26 (and thus the drill bit 30) and one or more sensors (e.g., a pressure sensor) for detecting pressure of a fluid supply to the rotary head 26. The speed sensors may be disposed on or near the rotary head 26 and the pressure sensors may be disposed within a fluid supply line of the rotary head 26. Alternatively, any sensor associated with drill rotation torque input 216 may be disposed in other locations relative to the rotary head 26 and/or drill bit 30. Drill rotation torque input 216 may also derive rotation torque information from other sources, including other sensors.

Feed rate input 218 may be a sensor or other mechanism configured to detect and/or communicate a feed rate of the drill bit 30. Feed rate input 218 may communicate a feed rate signal indicative of a feed rate of the drill bit 30 to controller 210. For example, feed rate input 218 may monitor a rotation speed of a sheave of the cable and pulley system for moving rotary head 26 up and down along the mast frame 24. Feed rate input 218 may embody a conventional rotational speed detector (e.g., a rotary encoder) having a stationary element rigidly connected to a mounting bracket of the sheave that is configured to sense a relative rotational movement of the sheave (e.g., of a shaft of the sheave). The stationary element may be a magnetic or optical element mounted to the mounting bracket of the sheave and configured to detect rotation of an indexing element (e.g., a toothed tone wheel, an embedded magnet, a calibration stripe, teeth of a timing gear, etc.) connected to rotate with the shaft of the sheave. A sensor of feed rate input 218 may be located adjacent the indexing element and configured to generate a signal each time the indexing element (or a portion thereof) passes near the stationary element. The signal may be directed to controller 210, which may use the signal to determine a number of shaft rotations of the sheave, occurring within fixed time intervals, and use this information to determine the feed rate value. Feed rate input 218 may also derive feed rate information from other sources, including other sensors.

Rotation speed input 220 may be a sensor (e.g., a speed sensor) that may be configured to detect a rotation speed of the drill bit 30. Rotation speed input 220 may communicate a rotation speed signal indicative of a rotation speed of the drill bit 30 to controller 210. For example, rotation speed input 220 may monitor the rotation speed of the rotary head 26. Rotation speed input 220 may embody a conventional rotational speed detector having a stationary element rigidly connected to the rotary head 26 that is configured to sense a relative rotational movement of the rotary head 26 (e.g., of a rotational portion of the rotary head 26 that is operatively connected to the rotary head 26, such as a shaft of the rotary head 26 or the drill string 28 mounted on the rotary head 26). The stationary element may be a magnetic or optical element mounted to a housing of the rotary head assembly and configured to detect rotation of an indexing element (e.g., a toothed tone wheel, an embedded magnet, a calibration stripe, teeth of a timing gear, etc.) connected to rotate with the shaft of the rotary head 26. A sensor of rotation speed input 220 may be located adjacent the indexing element and configured to generate a signal each time the indexing element (or a portion thereof) passes near the stationary element. The signal may be directed to controller 210, which may use the signal to determine a number of shaft rotations of the rotary head 26, occurring within fixed time intervals, and use this information to determine the rotation speed value. Rotation speed input 220 may also derive rotation speed information from other sources, including other sensors.

For outputs of control system 200, feed command 230 may cause actuation of the hydraulic feed cylinder 34 and may cause a change of position of rotary head 26 up and down along the mast frame 24. As such, feed command 230 may control the feed rate of drill bit 30 into and out of the hole 50. Air supply command 232 may cause actuation of a valve in the air supply line of the rotary head 26. As such, air supply command 26 may control air pressure exerted on the drill bit 30. Drill string rotation command 234 may cause actuation of the valve of hydraulic fluid line of the rotary head 26. As such, drill string rotation command 234 may control the rotation speed of the drill string 28 (and thus the drill bit 30). Watering command 236 may cause actuation of a valve of the watering line. As such, the watering command 236 may control water pressure and amount of water of the watering line. Display outputs 238 can take many different forms to inform the operator or remote personnel of the status of various aspects of the anti-jam control system 200.

Figure 3:
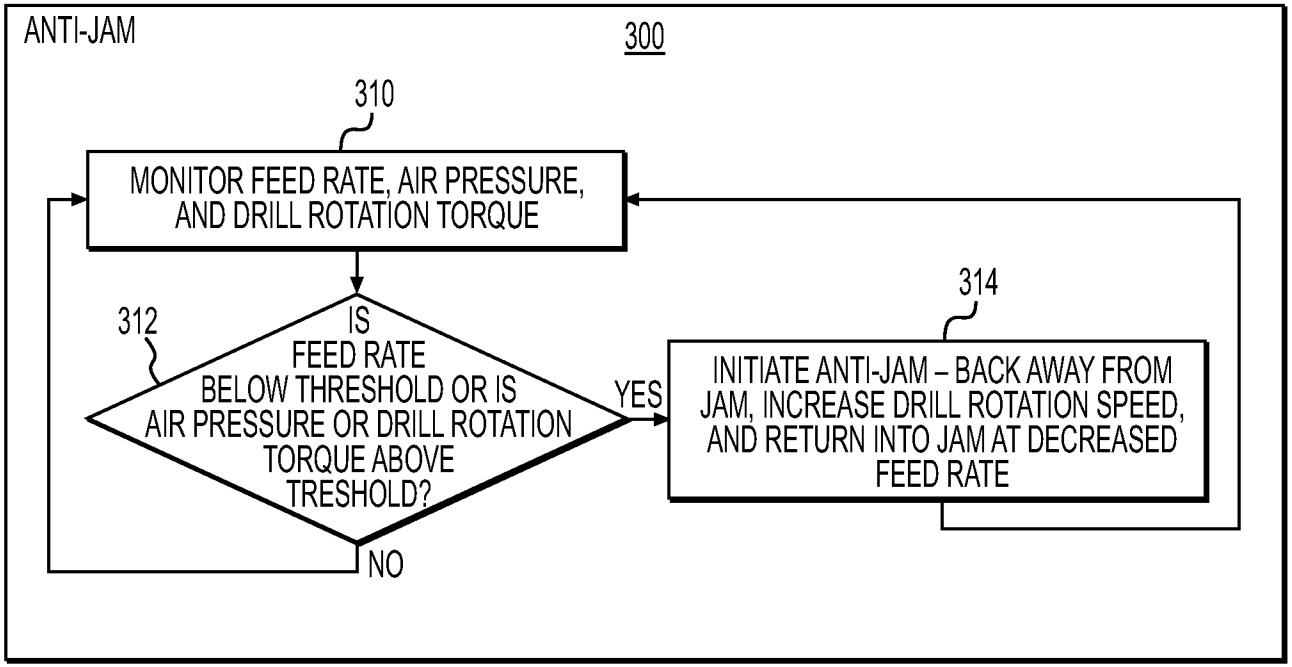
FIG. 3 is a flowchart depicting an exemplary automatic anti-jam function of the anti-jam control system if FIGS. 1 and 2.

FIG. 3 provides an exemplary anti-jam function 300 for the automatic drilling operation. During the collar phase, drill hole phase, and/or retract phase, controller 210 may monitor, or measure, bit air pressure 212, drill rotation torque 216, and/or feed rate 218 (step 310). Under certain conditions, the measured bit air pressure 212 and/or the measured drill rotation torque 216 on the drill string 28 may increase beyond their respective limits during one or more phases of the drilling operation. Further, under certain conditions, the measured feed rate 218 may decrease beyond its respective limit during one or more phases of the drilling operation. These conditions may represent a jam or impending jam of the drill bit 30. The anti-jam function 300 may be configured to automatically react to these conditions. In particular, if the measured feed rate 218 decreases below a predetermined feed rate threshold and/or if the measured bit air pressure 212 and/or the measured drill rotation torque 216 increases above a predetermined bit air pressure threshold or drill rotation torque threshold, respectively (step 312), the controller 210 may automatically initiate an "anti-jam" operation (step 314). The predetermined feed rate threshold may be, for example, two millimeters per second (2 mm/s). In some instances, the measured feed rate 218 may decrease beyond its respective limit prior to the measured bit air pressure 212 and/or the measured drill rotation torque 216 increasing beyond their respective limits. In one embodiment, controller 210 may automatically initiate the anti-jam operation when one or more of the inputs 212, 216, 218 exceed the predetermined thresholds for a predetermined amount of time. For example, controller 210 may automatically initiate the anti-jam operation when the measured feed rate 218 decreases below the predetermined feed rate threshold for the predetermined amount of time.

The anti-jam operation may include sending a feed command 230 to move the drill string 28 in a hoist/retract direction or a feed direction to back away from the jam. Further, the feed command 230 may include an increased pulldown force (e.g., in the feed direction or hoist direction) to back away from the jam. A drill string rotation command 234 may be sent to increase the drill string rotation speed to a high speed (a speed significantly higher than the speed prior to the anti-jam operation, for example between 60-80% of a max rotation limit). Once the drill string 28 has reached the desired high speed condition, a feed command 230 may be provided to slowly feed the drill bit 30 into the jam. The feed command 230 may include a decreased pulldown force (e.g., in the feed direction or hoist direction) to feed the drill bit 30 into the jam. The slow feed rate can be significantly slower than the feed prior to the anti-jam operation, for example between 5-20% of the feed rate limit). The direction of movement of the drill string 28 could be in either the feed direction or the hoist/retracting direction, depending on whether the jam is determined to be at the bottom of the hole (e.g., below the drill bit 30) or above the drill bit 30 due to a caving in of the hole. Further, the direction of movement of the drill string 28 could be in either the feed direction or the hoist/retracting direction, depending on whether the drill string 28 is being fed towards the bottom of the hole (e.g., during the collar phase and/or the drill hole phase) or being retracted prior to the anti-jam operation. Even further, the anti-jam operation may cycle between the feed direction and the hoist/retracting direction if jams occur both above and below the drill bit 30. This process of backing away from the jam and slowly reentering the jam can be automatically repeated until the jam is cleared (e.g. feed rate 218 increases or bit air pressure 212 and/or drill rotation torque 216 are lowered to acceptable levels).

The predetermined thresholds for bit air pressure 212, drill rotation torque 216, and feed rate 218 may be configurable—adjustable based on user inputs, or may be manufacturer set values and not configurable. Further, it is understood that controller 210 may monitor other inputs 212-220, such as pulldown force 214, rotation speed 220, hydraulic tank pressure, or any other drilling input, for initiating the anti-jam operation, as described above.

Figure 4:
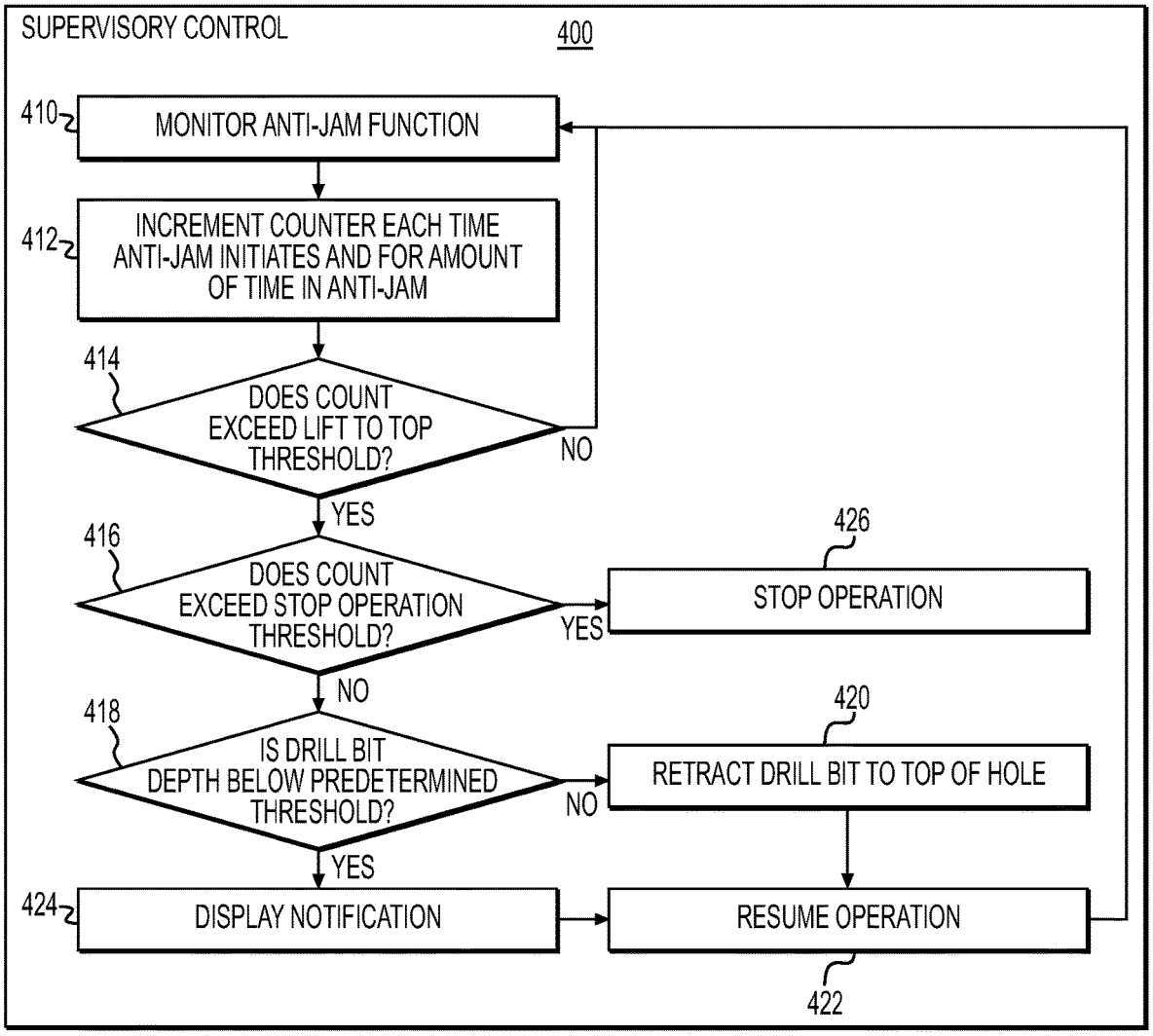
FIG. 4 is a flowchart depicting an exemplary supervisory control function of the anti-jam control system of FIGS. 1-3.

FIG. 4 provides an exemplary supervisory control function 400 for the anti-jam operation. The supervisory control function 400 may monitor the anti-jam function 300 (step 410). For example, controller 210 may monitor the anti-jam function 300 for when the anti-jam operation is initiated. Controller 210 may increment a counter each time the anti-jam operation is initiated, and increment the same counter at a predetermined rate for the amount of time or duration that the drill is in the anti-jam operation (step 412). For example, the counter may add a value to a count when the counter is incremented. Because the counter is being incremented by both instances (when anti-jam is initiated) and time values (how long drill is in the anti-jam operation), a normalization may be applied to one or both of the values. For example, controller 210 may normalize the initiation value by adding a predetermined number (e.g., five seconds) to the counter whenever the anti-jam operation is initiated, and add the actual time value (in seconds) to the counter. For example, the counter may be incremented by five seconds each time the anti-jam operation is initiated and the amount of seconds the drill is in the anti-jam operation may be added to the same count. In some embodiments, a normalization factor may be applied to the amount of time in the anti-jam operation, such that controller 210 multiplies the amount of time in the anti-jam operation by the normalization factor. It is understood that the values for the predetermined number and the weight factor are exemplary only and the values may be different. Further, it is understood that multiple counters may be used so as to avoid the need for normalization between anti-jam initiation and duration. In such a separate count system, exceeding the count may trigger the mitigation procedures discussed below. Even further, the predetermined number and the normalization factor may be preset and non-configurable, or configurable. Controller 210 may then determine whether the count exceeds a first threshold—a lift to top threshold (step 414). Controller 210 may also determine whether the count exceeds a second threshold—a stop operation threshold (step 416). The second threshold may be greater than the first threshold.

The supervisory control function 400 may include one or more automatic mitigation procedures when the anti-jam operation is initiated a large amount and/or if the anti-jam operation runs for a prolonged period of time. As used herein, a "mitigation procedure" is an operation performed by controller 210 for responding to the excess attempts of the anti-jam operation or time in the anti-jam operation. For example, if the count exceeds the first threshold (step 414—Yes), but is less than the second threshold (step 416—No), controller 210 may determine if the depth of the drill bit 30 is below a predetermined depth threshold (step 418). If the drill bit 30 is above the predetermined depth threshold (step 418—No), controller 210 may automatically attempt to retract the drill bit 30 to the top of the hole 50 (step 420). For example, controller 210 may retract drill bit 30 to the top of the hole 50 if another jam is not encountered during retraction. If jam occurs during retraction, controller 210 may initiate the anti-jam operation, as described above. Controller 210 may reset the count and/or timer when the drill bit 30 is retracted to the top of the hole 50. Alternatively, or additionally, controller 210 may decrement the counter for an amount of time not in the anti-jam operation (e.g., in a normal operation, such as the collar phase, drill hole phase, and/or retract phase of the drilling operation). Controller 210 may then automatically resume operation (step 422) and continue monitoring the anti-jam function 300 (step 410), as detailed above. The predetermined depth threshold corresponds to the drill string 28 length, such that when the drill bit 30 is below the predetermined depth threshold, the drill string 28 will be longer than the maximum lift height of the rotary head 26 on mast frame 24. Thus, when the drill bit 30 is below the predetermined depth threshold, controller 210 may be unable to retract the drill bit 30 to the top of the hole 50. As such, if the drill bit 30 is below the predetermined depth threshold (step 418—Yes), controller 210 may display a notification on input device 40 (step 424). Controller 210 may then automatically resume operation (step 422) and continue monitoring the anti-jam function 300 (step 410), as detailed above. The notification may inform an operator, or other personnel, that the count has exceeded the second threshold so that the operator may stop the automatic drilling mode and manually attempt to diagnose and clear the jam.

Under certain conditions, drilling machine 10 may not be able to clear a jam by the anti-jam function 300. Thus, controller 210 may continue to attempt the anti-jam operation for a large amount of attempts and/or for a long period of time. Therefore, if the total count exceeds the second threshold (step 416—Yes), controller 210 may stop the operation (step 426). For example, controller 210 may stop collaring, drilling, and/or retracting. Controller 210 may reset the count and/or timer when operation is stopped. Thus, the mitigation procedures may include automatically retracting the drill bit 30 to the top of the hole 50 (e.g., a first mitigation procedure), displaying a notification (e.g., a second mitigation procedure), and/or stopping the drilling operation (e.g., a third mitigation procedure).

The first threshold (e.g., the lift to top threshold) and the second threshold (e.g., the stop operation threshold) for the total count may be configurable—adjustable based on user inputs, or may be manufacturer set values and not configurable.

INDUSTRIAL APPLICABILITY

The disclosed aspects of the anti-jam control system 200 of the present disclosure may be used in any drilling machine having an automatic operation mode.

As used herein, the terms automated and automatic are used to describe functions that are done without user intervention. Thus, the automatic anti-jam operation, including the various functions of FIGS. 3-4, may all proceed without user intervention.

Such an anti-jam control system 200 may help efficiently enable an automatic drilling operation. For example, the disclosed system 200 may automatically clear and prevent jams during the automatic drilling operation. The disclosed system 200 may monitor feed rate of the drill bit, as described above, and control feed rate, drill string rotation, and air supply functions to automatically detect and clear jams sooner. For example, feed rate may decrease below a threshold before bit air pressure and rotation torque increase above their thresholds for initiating the anti-jam operation. Further, system 200 may help to ensure the anti-jam operation is not continuously attempted when a jam is unable to be cleared. Such a system 200 may create a more intuitive operator control and may allow more autonomy of the drilling machine 10. Thus, the anti-jam control system 200 of the present disclosure may help operators execute the drilling operation and may help to reduce damage to the drill bit during the drilling operation, while decreasing overall drilling time.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for automatically clearing a jam during an automatic drilling mode of a mobile drilling machine including a drill bit mounted on a drill string, the method comprising:

monitoring a feed rate of the drill bit during the automatic drilling mode;

automatically initiating an anti-jam operation when the feed rate is below a predetermined feed rate threshold;

monitoring an anti-jam function during the automatic drilling mode;

incrementing a counter each time the anti-jam operation of the anti-jam function is initiated;

incrementing the counter at a predetermined rate for an amount of time in the anti-jam operation; and automatically initiating a mitigation procedure when a count of the counter exceeds a threshold, wherein the threshold includes a first threshold and the mitigation procedure includes a first mitigation procedure, and wherein the method further comprises:

automatically retracting the drill bit to a top of a hole when the count exceeds the first threshold and when the drill bit is above a predetermined depth threshold.

2. The method of claim 1, further comprising:

automatically initiating the anti-jam operation when the feed rate decreases below the predetermined feed rate threshold for a predetermined amount of time.

3. The method of claim 1, further comprising:

monitoring bit air pressure and rotation torque of the drill bit during the automatic drilling mode; and automatically initiating the anti-jam operation when the bit air pressure is above a predetermined bit air pressure threshold or the rotation torque is above a predetermined rotation torque threshold.

4. The method of claim 3, further comprising:

automatically initiating the anti-jam operation when the feed rate is below the predetermined feed rate threshold prior to the bit air pressure and drill rotation torque increasing above their respective predetermined thresholds.

5. The method of claim 1, wherein the increment for the amount of time in the anti-jam operation includes a normalization factor multiplied by the amount of time.

6. The method of claim 1, wherein the mitigation procedure includes a second mitigation procedure including: displaying a notification if the count exceeds the first threshold and the drill bit is below the predetermined depth threshold.

7. The method of claim 6, wherein the threshold includes a second threshold and the mitigation procedure includes a third mitigation procedure including:

automatically stopping the drilling operation if the count exceeds the first threshold and the second threshold.

8. The method of claim 7, wherein the second threshold is greater than the first threshold.

9. A mobile drilling machine, comprising:

a mast including a mast frame;

a rotary head movably mounted on the mast frame, the rotary head controllable to rotate a drill bit mounted on a drill string at a rotation speed, wherein the rotary head is further controllable to move up and down the mast frame to feed the drill bit at a feed rate; and a controller configured to:

monitor the feed rate of the drill bit during an automatic drilling mode;

automatically initiate an anti-jam operation when the feed rate is below a predetermined feed rate threshold;

monitor an anti-jam function during the automatic drilling mode of the mobile drilling machine;

increment a counter each time the anti-jam operation of the anti-jam function is initiated;

increment the counter at a predetermined rate for an amount of time in the anti-jam operation; and automatically initiate a mitigation procedure when a count of the counter exceeds a threshold, wherein the threshold includes a first threshold and the mitigation procedure includes a first mitigation procedure including: automatically retracting, using the controller, the drill bit to a top of a hole responsive to the count exceeding the first threshold and so long as the drill bit is above a predetermined depth threshold.

10. The mobile drilling machine of claim 9, wherein the controller is further configured to: automatically initiate the anti-jam operation when the feed rate decreases below the predetermined feed rate threshold for a predetermined amount of time.

11. The mobile drilling machine of claim 9, wherein the controller is further configured to:

monitor bit air pressure and rotation torque of the drill bit during the automatic drilling mode; and automatically initiate the anti-jam operation when the bit air pressure is above a predetermined bit air pressure threshold or the rotation torque is above a predetermined rotation torque threshold.

12. The mobile drilling machine of claim 11, wherein the controller is further configured to:

automatically initiate the anti-jam operation when the feed rate is below the predetermined feed rate threshold prior to the bit air pressure and drill rotation torque increasing above their respective predetermined thresholds.

13. The mobile drilling machine of claim 9, wherein the increment for the amount of time in the anti-jam operation includes a normalization factor multiplied by the amount of time.

14. The mobile drilling machine of claim 9, wherein the mitigation procedure includes a second mitigation procedure, and wherein the controller is further configured to: display a notification if the count exceeds the first threshold and the drill bit is below the predetermined depth threshold.

15. The mobile drilling machine of claim 14, wherein the threshold includes a second threshold and the mitigation procedure includes a third mitigation procedure, and wherein the controller is further configured to:

automatically stop the drilling operation if the count exceeds the first threshold and the second threshold.

16. A method for automatically clearing a jam during an automatic drilling mode of a mobile drilling machine including a drill bit mounted on a drill string, the method comprising:

monitoring a feed rate, bit air pressure, and rotation torque of the drill bit during the automatic drilling mode;

automatically initiating an anti-jam operation when the feed rate is below a predetermined feed rate threshold, the bit air pressure is above a predetermined bit air pressure threshold, or the rotation torque is above a predetermined rotation torque threshold;

incrementing a counter each time the anti-jam operation is initiated;

incrementing the counter at a predetermined rate for an amount of time in the anti-jam operation; and automatically initiating a mitigation procedure when a count of the counter exceeds a threshold, wherein the threshold includes a first threshold and the mitigation procedure includes a first mitigation procedure, and wherein the method further comprises:

automatically retracting the drill bit responsive to the count exceeding the first threshold and so long as the drill bit is above a predetermined depth threshold.

* * * * *